United States Patent [19]

Watson

[11] Patent Number: 5,022,416

[45] Date of Patent: Jun. 11, 1991

[54] SPRAY CYLINDER WITH RETRACTABLE PINS

[75] Inventor: John Watson, Doswell, Va.

[73] Assignee: Philip Morris Incorporated, New York, N.Y.

[21] Appl. No.: 481,949

[22] Filed: Feb. 20, 1990

[51] Int. Cl.[5] ..... A24B 3/10; A24B 3/12; A24B 3/18

[52] U.S. Cl. ..... 131/305

[58] Field of Search ..... 131/305

[56] References Cited

U.S. PATENT DOCUMENTS

| | | | |
|---|---|---|---|
| 687,308 | 11/1901 | Hawkins | 131/305 |
| 4,657,031 | 4/1987 | Sartoni . | |
| 4,681,124 | 7/1987 | Hinzmann et al. . | |
| 4,730,627 | 3/1988 | Burcham, Jr. et al. . | |

FOREIGN PATENT DOCUMENTS

| | | | |
|---|---|---|---|
| 3001734 | 7/1981 | Fed. Rep. of Germany | 131/305 |

*Primary Examiner*—V. Miller

*Attorney, Agent, or Firm*—Robert R. Jackson

[57] ABSTRACT

Retractable, self-cleaning pins are mounted on a rotating spray cylinder. Each pin is caused to extend into the cylinder during the upward motion of the pin in order to help convey material within the cylinder. Retraction of each pin occurs during its downward motion in order to remove material adhered to the pin. Extension and retraction of the pins may be controlled by such means as a cam. If desired, the interior surface of the cylinder may be scraped (e.g., by a stationary scraper) where the pins are retracted.

10 Claims, 3 Drawing Sheets

SPRAY CYLINDER WITH RETRACTABLE PINS

BACKGROUND OF THE INVENTION

This invention relates to spray cylinders, and more particularly to spray cylinders having retractable pins.

Stationary pins positioned on the inside walls of spray cylinders are currently used in conveying and mixing tobacco or other similar materials during rotation of the cylinder for such purposes as blending, steam-conditioning, drying, and applying flavorants. Highly-saturated clumps of tobacco or other similar materials tend to accumulate on or around these stationary pins. The clumps may not be dried to desired moisture levels, and remain saturated Those clumps which subsequently fall into the tobacco or other similar materials within the cylinder disturb the uniform moisture level and flavorant concentration of the tobacco or other similar materials. In the case of tobacco, this can result in spotting on cigarettes. Additionally, those clumps which do not fall remain adhered to the stationary pins, spray rack, and inside wall of the cylinder. These clumps must be disposed of, resulting in waste of starting material. It is desirable to convey the tobacco or other similar materials during rotation of the cylinder in such a way that uniform moisture and flavorant concentrations are achieved without the accumulation of material into clumps.

In view of the foregoing, it is an object of this invention to provide a spray cylinder which will convey the material placed within it without allowing accumulation of the material.

SUMMARY OF THE INVENTION

This and other objects of the invention are accomplished in accordance with the principles of the invention by providing retractable, self-cleaning pins mounted on the wall of the rotating cylinder. These retractable pins extend into the cylinder during the upward portion of rotation when they are needed to convey the material, and retract out during the downward portion when they are not needed.

Further features of the invention, its nature and various advantages will be more apparent from the accompanying drawings and the following detailed description of the preferred embodiments.

DETAILED DESCRIPTION OF THE PREFERRED EMBODIMENTS

Although the principles of this invention are applicable to blend, steam-condition, dry, or add flavorants to materials such as tobacco, the invention will be fully understood from the following explanation of an illustrative embodiment in the context of cylinders used for applying a spray to strip tobacco.

Figure 1:
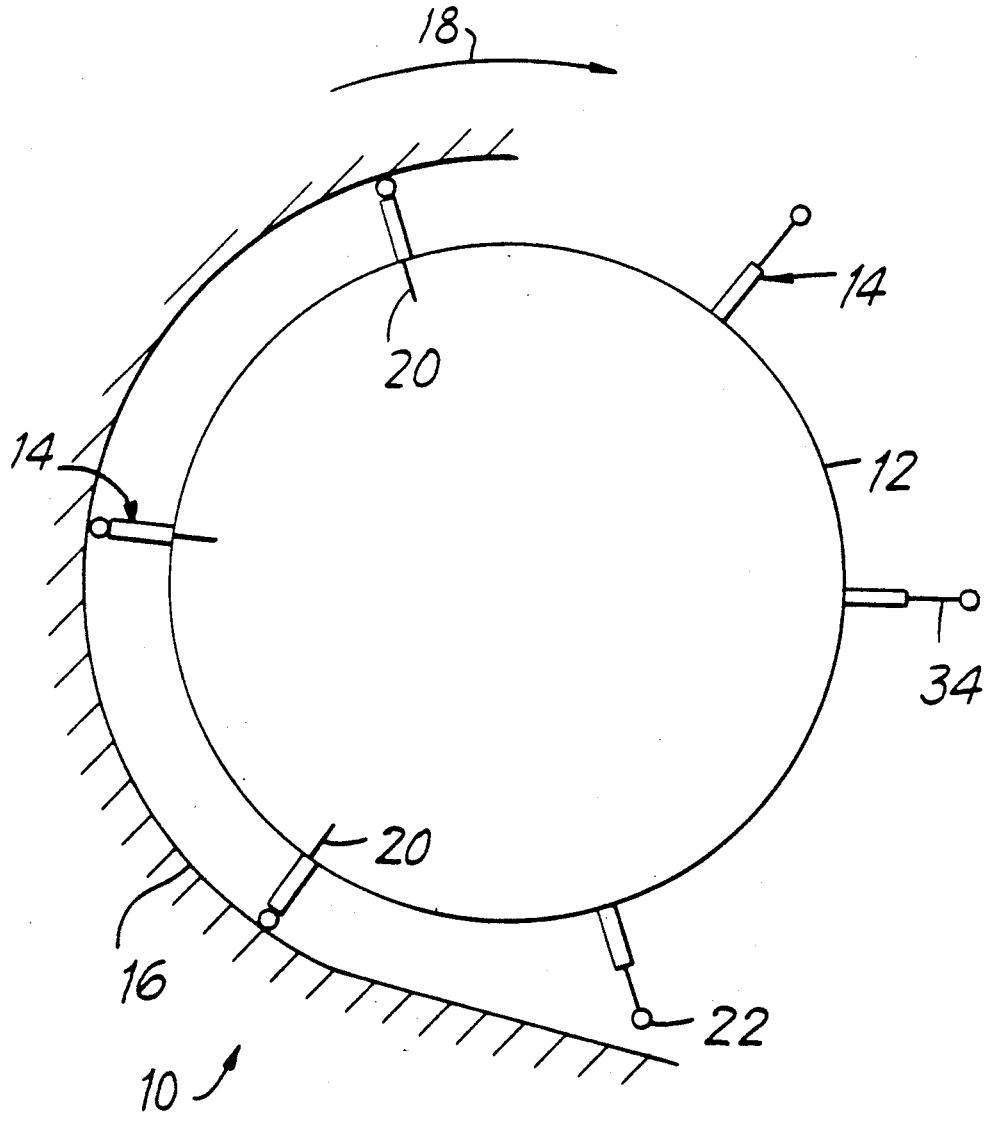
FIG. 1 is a simplified cross-sectional view of an illustrative embodiment of a spray cylinder according to this invention.

As shown in FIG. 1, a preferred embodiment of a retractable pin system 10 of this invention includes cylinder 12, retractable pins 14, and cam 16. The central longitudinal axis of cylinder 12 is typically horizontal or somewhat inclined and is therefore sometimes referred to herein as "substantially horizontal." System 10 includes a plurality of retractable pins 14 which are preferably positioned on the outer surface of cylinder 12. These pins may be distributed in any fashion about the circumference and length of cylinder 12. Each retractable pin 14 is preferably mounted substantially normal to the surface of cylinder 12 (i.e., substantially radially of the cylinder) and over an associated opening in the cylinder wall. A portion of each retractable pin 14, indicated by reference number 20, is extendable through the opening in cylinder 12 in which the retractable pin 14 is mounted. Another portion of each retractable pin 14, in particular cam follower 22, is designed to come into contact with, and move along cam 16.

During operation of the apparatus, cylinder 12 rotates about its longitudinal axis, as shown by arrow 18. As the rotation of cylinder 12 brings the cam follower 22 of each retractable pin 14 into contact with cam 16, portion 20 of that retractable pin 14 extends into the cylinder. Once the rotation of cylinder 12 moves a given retractable pin 14 away from cam 16, portion 20 of that pin is retracted from the inside of the cylinder by an associated prestressed compression spring 26 (see FIG. 2). Compression spring 26 is located within the cylindrical housing 24 of each retractable pin 14. During retraction, material which may have adhered to portion 20 is removed or scraped from portion 20 by a lip seal 28 (e.g., of metal such as stainless steel or carbon steel or any other suitable material) located where retractable pin 14 passes through bushing 30. In the preferred embodiment of the invention, portion 20 of each retractable pin 14 is extended into cylinder 12 during the generally upward movement of that pin in order to help convey the material within cylinder 12. Portion 20 of each retractable pin 14 is retracted from the inside of cylinder 12 during t he generally downward movement of that pin allowing the material being conveyed within cylinder 12 to fall freely.

Figure 2:
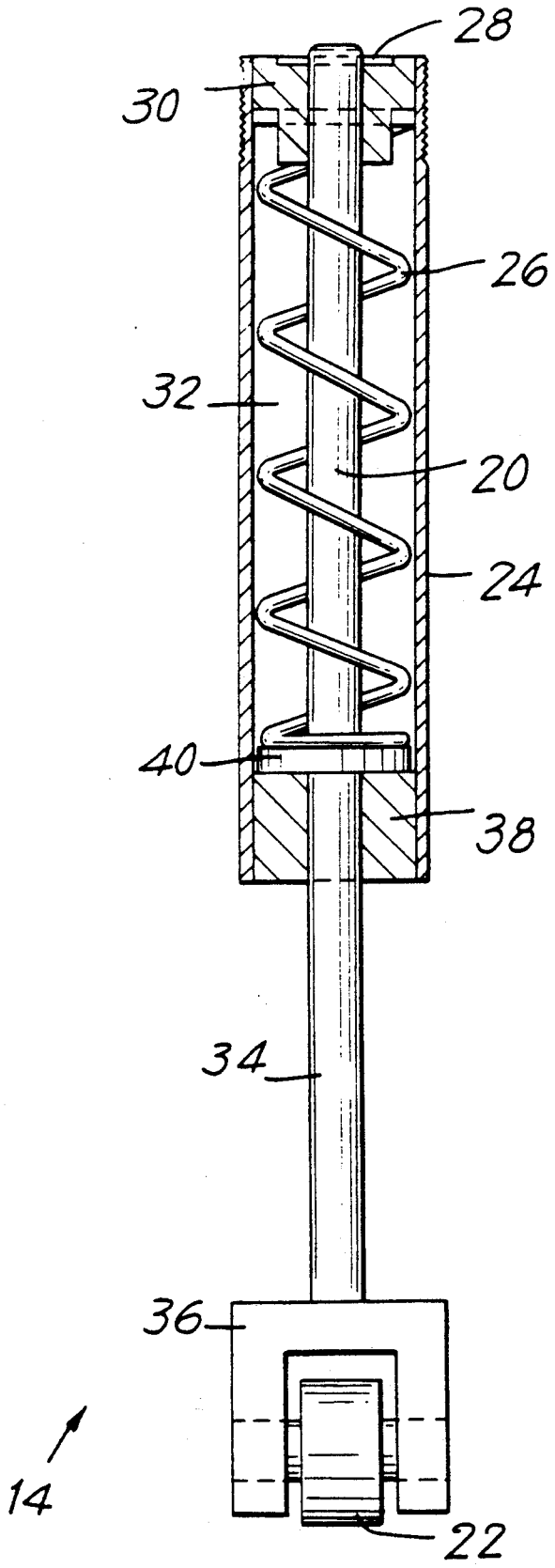
FIG. 2 is a longitudinal view, partly in section, of a retractable, self-cleaning pin of the apparatus shown in FIG. 1.

FIG. 2 shows a preferred embodiment of a retractable pin 14 in greater detail. In its relaxed position retractable pin 14 is held retracted from the inside of cylinder 12 by compression spring 26 located in spring cavity 32 inside cylindrical housing 24. The inner end of spring 26 bears on bushing 30 (which is effectively an extension of the wall of cylinder 12), and the outer end of spring 26 bears on collar 40, which travels with extendable portion 20, and which rests against bushing 38 during the relaxation state of spring 26. Spring 26 coils around extendable portion 20, which is typically round in cross section. As cam follower 22, which may be a roller bearing held in place by a mounting bracket 36, comes into contact with cam 16, extendable portion 20 is pushed into the interior of cylinder 12. Portion 34 of retractable pin 14 is disposed outside cylindrical housing 24 during the relaxation state of spring 26, and is preferably noncircular (e.g., square) in cross section so as to prevent rotation of mounting bracket 36. Once the rotation of cylinder 12 moves cam follower 22 away from cam 16, compression spring 26 returns to its relaxation state and causes extended portion 20 to retract from the inside of cylinder 12.

Figure 3:
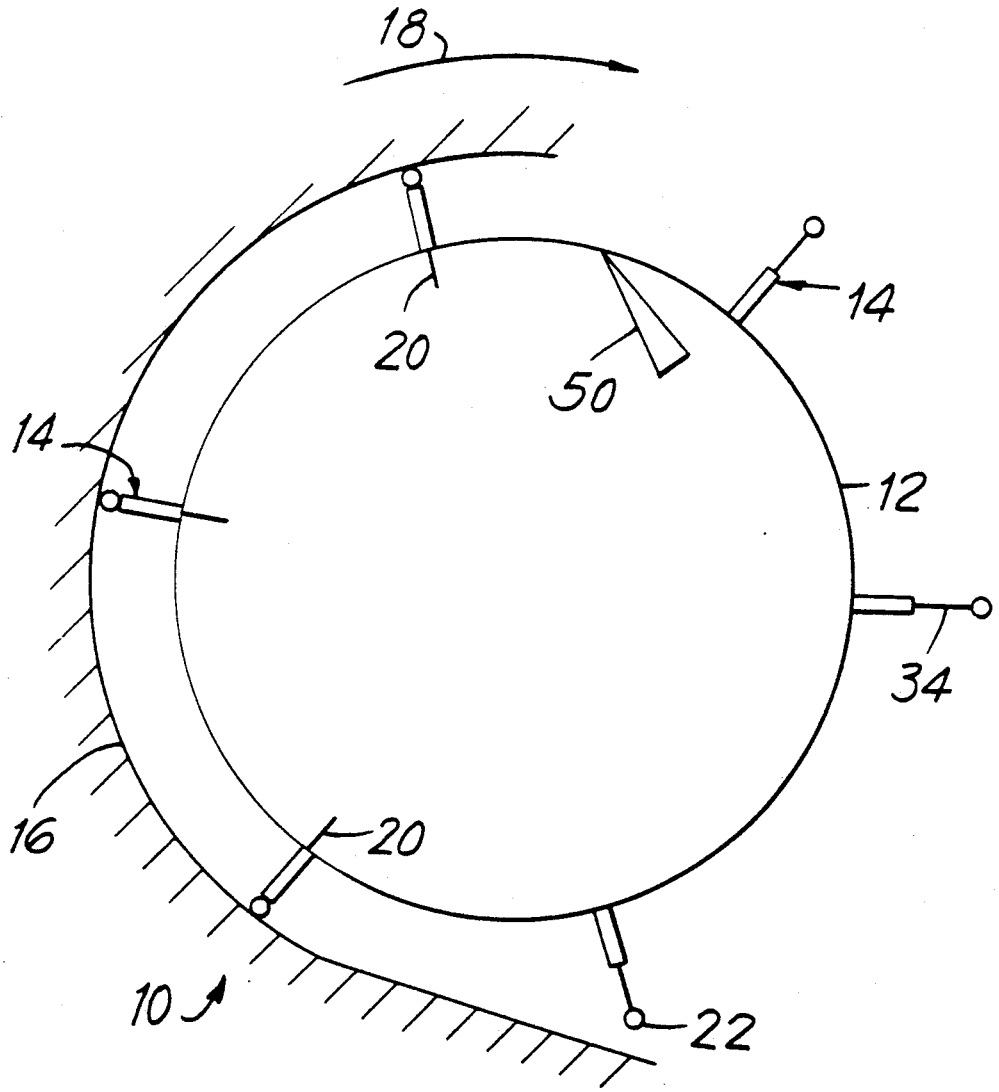
FIG. 3 is a view similar to FIG. 1 showing an alternative illustrative embodiment of the apparatus of this invention.

Because pins 14 are withdrawn from the interior of cylinder 12 in one circumferential region of the cylinder, a stationary scraper 50 (FIG. 3) can (if desired) be mounted so that it extends axially through the cylinder and scrapes the wall of the cylinder as it passes through that circumferential region. Pins 14 and scraper 50 do not interfere with one another because pins 14 are withdrawn from the interior of cylinder 12 as the pins pass the scraper. If provided, scraper 50 helps prevent the adherence of any portion of the material being processed to the inner surface of cylinder 12.

It will be understood that the foregoing is merely illustrative of the principles of this invention, and that various modifications can be made by those skilled in the art without departing from the scope and spirit of the invention. For example, although spring 26 is located between bushing 30 and collar 40 in the depicted embodiment, it could alternatively be located between bracket 36 and bushing 38 (although in that event it would not be protected by housing 24 as in the depicted preferred embodiment). As another alternative, compression spring 26 could be replaced by a prestressed tension spring connected at one end to bushing 38 and at the other end to a part of extendable portion 20 which always remains inside housing 24. As still another example of possible modifications within the scope of this invention, although in the depicted embodiment spring 26 resiliently biases pin 20 outwardly of cylinder 12 and cam 16 pushes the pin into the cylinder, the spring (e.g., a tension spring in place of compression spring 26) could be used to resiliently bias the pin into the cylinder, while the cam (e.g., a cam disposed between cylinder 12 and bracket 36) is used to pull the pin out of the cylinder. Electrical, electromagnetic, or pneumatic means could also be used to control the radial positions of the pins. As yet another example, although the retractable pins are uniformly distributed around the circumference of the cylinder in FIG. 1, it will be readily apparent that the apparatus can be modified so that the retractable pins are nonuniformly distributed about the circumference and length of the cylinder.

The invention claimed is:

1. A rotating spray cylinder usable for such purposes as blending, steam-conditioning, drying, and applying flavorants to tobacco placed within it comprising:

a plurality of retractable pins mounted on the wall of the cylinder; and means for alternately extending and retracting each pin into and out of the interior of the cylinder as the cylinder rotates in order to help convey the material within the cylinder while the pin is extended.

2. The apparatus defined in claim 1 wherein said means for alternately extending and retracting extends each pin into the interior of the cylinder during generally upward movement of that pin, and retracts each pin from the interior of the cylinder during generally downward movement of that pin.

3. The apparatus defined in claim 1 wherein each pin has an extendable portion which extends into the interior of the cylinder when the means for alternately extending and retracting extends the pin, and a nonextendable portion which remains outside the cylinder at all times, and wherein the means for alternately extending and retracting each pin comprises:

a prestressed spring captured between the wall of the cylinder and a part of the non-extendable portion of said pin;

a cam follower attached to the nonextendable portion of the pin; and a cam disposed outside a portion of the circumference of the cylinder for contact by the cam follower in order to extend the pin into the interior of the cylinder.

4. The apparatus defined in claim 3 wherein the cam follower is a roller bearing.

5. The apparatus defined in claim 1 wherein each pin has an extendable portion which extends into the interior of the cylinder when the means for alternately extending and retracting extends the pin, and a nonextendable portion which remains outside the cylinder at all times further comprising:

means for surrounding and scraping the extended portion of each pin when the pin is retracted in order to remove any tobacco from the extended portion of the pin.

6. The apparatus defined in claim 1 further comprising:

means for scraping the interior surface of the cylinder where the pins are retracted from the interior of the cylinder.

7. The method of conveying and mixing tobacco in a hollow spray cylinder having (1) a substantially horizontal central longitudinal axis and (2) a plurality of longitudinal pins mounted on said cylinder so that the longitudinal axis of each pin is substantially radial of said cylinder, said pins being spaced from one another about the circumference of said cylinder, said method comprising the steps of:

rotating said cylinder about its central longitudinal axis;

extending a longitudinal portion of each pin parallel to its longitudinal axis into the interior of said cylinder during at least a portion of the time that the portion of the cylinder on which said pin is mounted is moving upward due to the rotation of said cylinder; and withdrawing said longitudinal portion of each pin parallel to its longitudinal axis from the interior of said cylinder after performing said extending step with respect to said pin.

8. The method defined in claim 7 wherein each pin is withdrawn as a result of performance of said withdrawing step during at least a portion of the time that the portion of the cylinder on which said pin is mounted is moving downward due to the rotation of said cylinder.

9. The method defined in claim 7 further comprising the step of:

scraping the surface of said longitudinal portion of each pin to remove any tobacco while performing said withdrawing step on said pin.

10. The method defined in claim 7 further comprising the step of:

scraping the interior surface of said cylinder where said pins are withdrawn.

* * * * *